US011701690B2

(12) United States Patent
Janes

(10) Patent No.: US 11,701,690 B2
(45) Date of Patent: Jul. 18, 2023

(54) APPARATUS AND METHOD FOR SORTING MODULAR BUILDING BLOCKS

(71) Applicant: Charles Dustin Janes, Santa Cruz, CA (US)

(72) Inventor: Charles Dustin Janes, Santa Cruz, CA (US)

( * ) Notice: Subject to any disclaimer, the term of this patent is extended or adjusted under 35 U.S.C. 154(b) by 0 days.

(21) Appl. No.: 16/805,473

(22) Filed: Feb. 28, 2020

(65) Prior Publication Data

US 2020/0276614 A1 Sep. 3, 2020

Related U.S. Application Data

(60) Provisional application No. 62/811,776, filed on Feb. 28, 2019.

(51) Int. Cl.
*B07B 1/46* (2006.01)

(52) U.S. Cl.
CPC ..... *B07B 1/469* (2013.01); *B07B 2201/04* (2013.01)

(58) Field of Classification Search
CPC ..... B07B 1/469; B07B 2201/04
USPC ..... 209/355
See application file for complete search history.

(56) References Cited

U.S. PATENT DOCUMENTS

| | | | | |
|---|---|---|---|---|
| 3,100,474 | A * | 8/1963 | Schneider | A01K 1/0114 119/462 |
| 3,315,807 | A * | 4/1967 | Rosen | A63H 33/32 209/337 |
| 7,987,990 | B2 * | 8/2011 | Srivatsan | A47B 67/04 209/354 |
| 9,885,194 | B1 * | 2/2018 | Hayes | C02F 1/385 |
| 10,758,940 | B1 * | 9/2020 | Young | B07B 1/02 |
| 2015/0325074 | A1 * | 11/2015 | Sprenger | G07F 9/06 232/44 |

* cited by examiner

*Primary Examiner* — Terrell H Matthews
(74) *Attorney, Agent, or Firm* — West & Associates, A PC; Stuart J. West; Charlotte Rodeen-Dickert

(57) ABSTRACT

A modular building block sorter comprising: a housing having at least two sides and a base and at least one perforated surface adapted to selectively engage with said at least two sides of said housing, wherein said base comprises a first portion and a second portion and wherein said base is other than substantially planar. In some embodiments the base can include one or more discontinuities.

16 Claims, 12 Drawing Sheets

APPARATUS AND METHOD FOR SORTING MODULAR BUILDING BLOCKS

CROSS-REFERENCE TO RELATED APPLICATION(S)

This application claims the benefit of priority to prior-filed and provisional patent application Ser. No. 62/811,776, filed Feb. 28, 2019 by Charles Dustin Janes, the entirety of which is hereby incorporated herein by reference.

BACKGROUND

Technical Field

The present device relates to the field of sorting technology and more specifically to the field of sorting technologies for modular building blocks.

Background

It is common today for children and adults to build from kits using one or more modular building block systems. Lego® brand (modular building blocks) and Duplo® brand (modular building blocks) are but two examples of many suppliers/brands of modular building blocks that come in a variety of sizes, shapes and colors. When using the pieces of modular construction sets it is often difficult and/or time consuming to locate pieces having the specific geometric properties that a user desires as the pieces are commonly mixed together and stored in single container. Alternately, some users may categorize and separate the pieces into containers having common geometric properties. However, this is time consuming. Additionally, construction of new models from a set of mixed modular blocks can be frustrating and/or time consuming. What is needed is a modular building block sorter that is capable of segregating blocks having differing geometric properties.

SUMMARY

A modular building block sorter comprising a housing having at least two sides and a base. The housing can also include at least one perforated surface adapted to selectively engage with said at least two sides of said housing. The base of the housing can also comprise a first portion and a second portion wherein said base is other than substantially planar.

Implementations may include one or more of the following features: The modular building block sorter can also include a base wherein the base includes an arc; the modular building block sorter can also include a base wherein said the base includes at least one discontinuity.

BRIEF DESCRIPTION OF THE DRAWINGS

Further details of the present device are explained with the help of the attached drawings in which.

DETAILED DESCRIPTION

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

Modular building blocks come in various sizes ranging from very large pieces to very small pieces. Moreover, modular building blocks also generally have protrusions and complimentary recesses laid out in an a×b grid pattern for each piece where "a" and "b" can be any known, convenient and/or desired numbers. By way of non-limiting example, pieces can be 4×0.4, 4×3 (or 3×4), 4×0.2 (or 2×4), 4×1 (or 1×4), 3×0.3, 3×0.2 (or 2×3), 3×1 (or 1×3) and so forth, down to 1×1 and/or smaller pieces.

Figure 1:
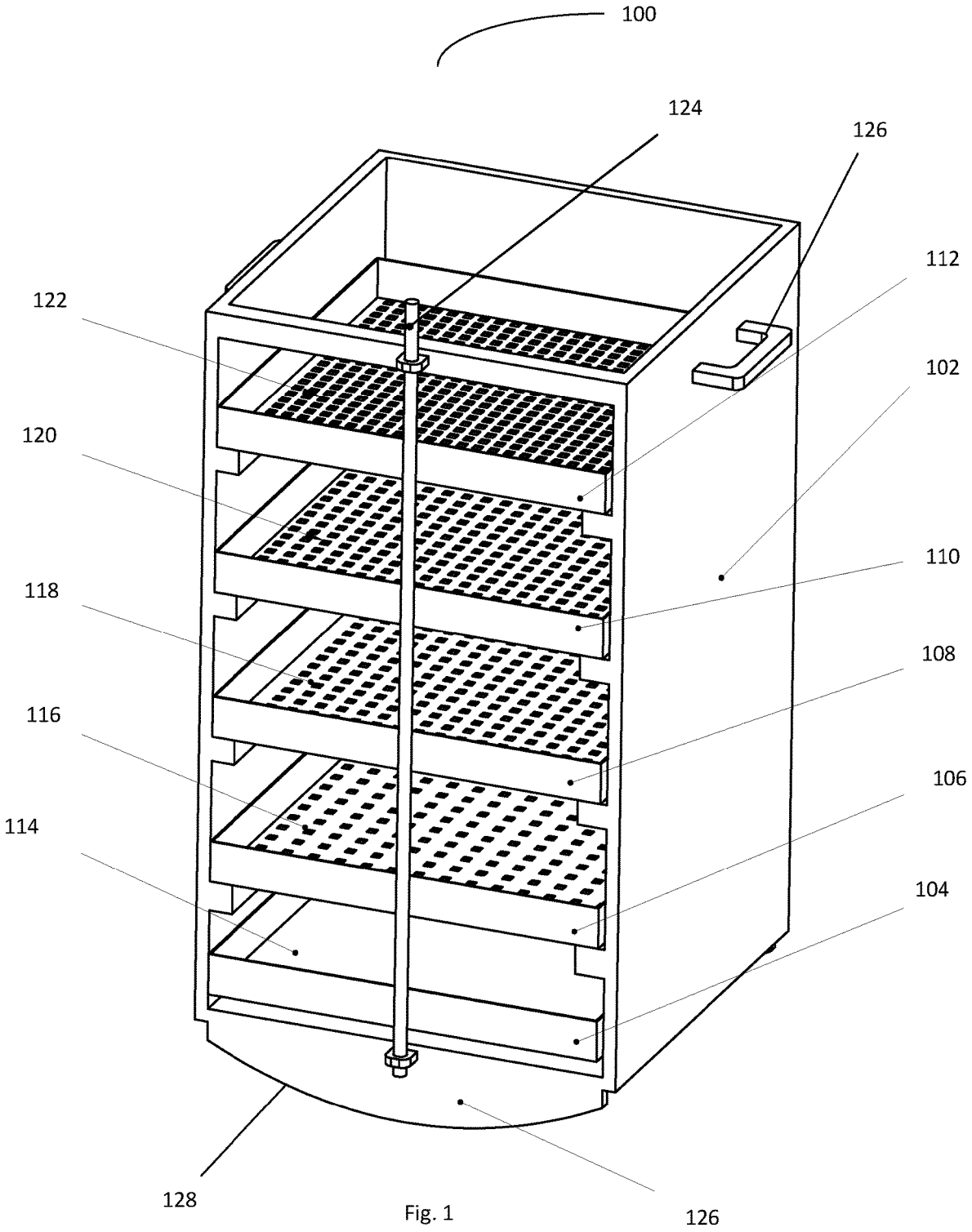
FIG. 1 depicts an embodiment of a modular building block sorter

FIG. 1 depicts an embodiment of a modular building block sorter 100. In the embodiment depicted in FIG. 1, the modular block sorter 100 comprises a housing (case) 102, a plurality of trays 104 106 108 110 112, a substantially solid surface 114, a plurality of perforated surfaces 116 118 120 122, a retention device 124 a base 126 having a curved lower surface 128. In some embodiments, one or more of the trays 104 106 108 110 112 and/or the substantially solid surface 114 and/or the plurality of perforated surfaces 116 118 120 122 and/or the retention device 124 can be absent. Moreover, in some embodiments, the retention device can comprise a locking mechanism such that when in a locked state one or more of the trays 104 106 108 110 112 can be constrained within the housing 102 until unlocked and/or one or more of the trays 104 106 108 110 112 can be restricted from engaging with the housing 102. Additionally, in some embodiments, the housing 102 can comprise a handle 130.

In the embodiment depicted in FIG. 1, the housing 102 can have any known, convenient and/or desired shape and/or geometry and the trays 104 106 108 110 112 can have any known, convenient and/or desired complimentary geometry such that the trays 104 106 108 110 112 can be selectively supported with the housing 102. Additionally, the base 126 can have any known convenient and/or desired curvature/arc as the curved lower surface 128.

In the embodiment depicted in FIG. 1, one or more of the plurality of trays 104 106 108 110 112 can be removably coupled with the housing. In some embodiments, each of the perforated surfaces 116 118 120 122 and the substantially solid surface 114 can be integral with a corresponding one of the plurality of trays 104 106 108 110 112. However, in alternate embodiments, the each of the perforated surfaces 116 118 120 122 and the substantially solid surface 114 can be selectively and removably coupled with any one or more of the trays 104 106 108 110 112. That is, each of the perforated surfaces 116 118 120 122 and the substantially solid surface 114 can be selectively coupled with any one of each of the trays 104 106 108 110 112. While depicted in FIG. 1 as housing 5 trays, in alternate embodiments the housing 102 can house any known, convenient and/or desired number of trays 104 106 108 110 112, selectively coupled with any known, convenient and/or desired number of perforated surfaces 116 118 120 122 and/or substantially solid surface(s) 114.

In some embodiments, each of the perforated surfaces 116 118 120 122 can comprise apertures adapted and configured to allow modular blocks smaller than specified dimensions to pass through the aperture. By way of non-limiting example (wherein in z is any number), in some embodiments, one of the perforated surfaces 116 can allow modular blocks smaller than 4×z to pass through the apertures in the perforated surface 116, a second one of the perforated surfaces 118 can allow modular blocks smaller than 3×z to pass through the apertures in the perforated surface 118, a third one of the perforated surfaces 120 can allow modular blocks smaller than 2×z to pass through the apertures in the perforated surface 120, a fourth one of the perforated surfaces 122 can allow modular blocks smaller than 1×z to pass through the apertures in the perforated surface 122 and the substantially solid surface 114 can be configures such that no modular blocks will pass through the substantially solid surface 114.

In some embodiments, the perforated surfaces 116 118 120 122 and the substantially solid surface 114 can be associated with trays 104 106 108 110 112, such that the perforated surface with the largest apertures is associated with the tray located farthest from the base 126 of the housing 102, the perforated surface with the next largest apertures is associated with the tray located second farthest from the base 126 of the housing 102, the perforated surface with the next largest apertures is associated with the tray located third farthest from the base 126 of the housing 102, the perforated surface with the next smallest apertures is associated with the tray located second closest to the base 126 of the housing 102 and the substantially solid surface 114 is associated with the tray closes to the base 126 of the housing 102.

The retention device 124 can be a rod that passing across an open face of the housing 102 that inhibits the trays 104 106 108 110 112 from disengaging from the housing 102. However, in alternate embodiment the retention device 124 can be any known, convenient and/or desired apparatus that inhibits the trays 104 106 108 110 112 from disengaging from the housing 102.

In operation, trays 104 106 108 110 112 can be installed in the housing and the substantially solid surface associated with the tray closes to the base 126 and with perforated surfaces 116 118 120 122 having increasingly larger apertures from lowest positioned tray 106 (above the substantially solid surface 114) to highest positioned tray 112. The trays 104 106 108 110 112 can then be secured within the housing by the retention device 124. The housing can then be agitated by rocking the housing while the base 126 is kept in contact with a surface on which the base 126 is standing, cause pieces smaller than the various aperture sizes to pass through the apertures in the various perforated surfaces 116 118 120 122 and thereby segregating the modular building blocks by size with larger pieces in the top tray and smallest pieces in the bottom tray (and progressively smaller pieces being segregated largest to smallest, top to bottom).

Figure 2A:
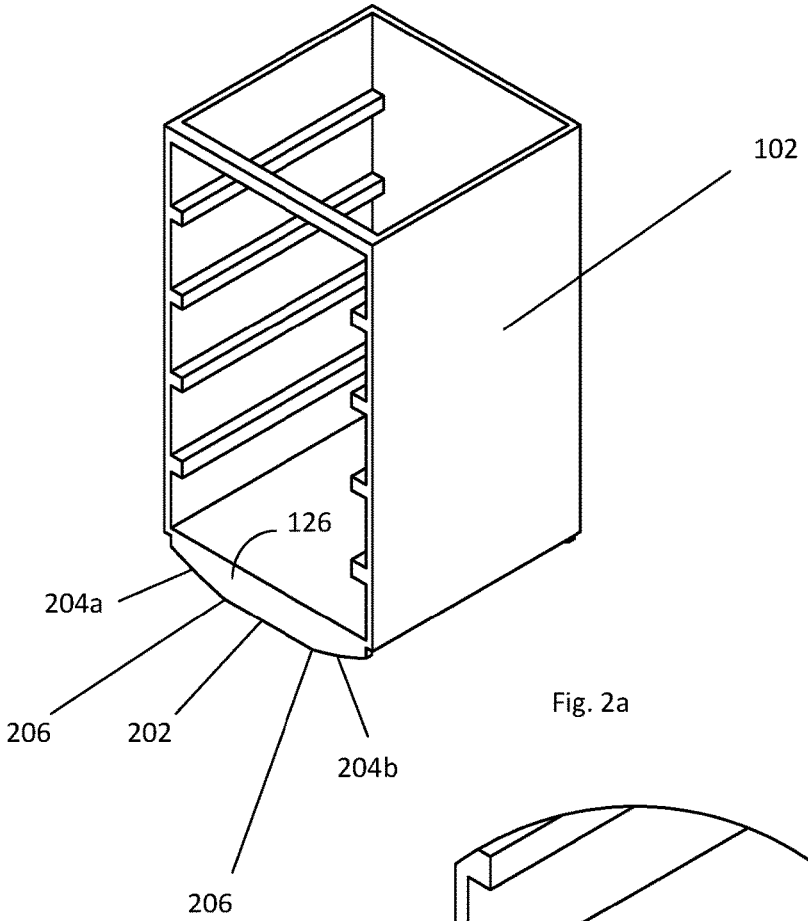
FIGS. 2*a* and 2*b* depict an alternate embodiment of a modular building block sorter
Figure 2B:
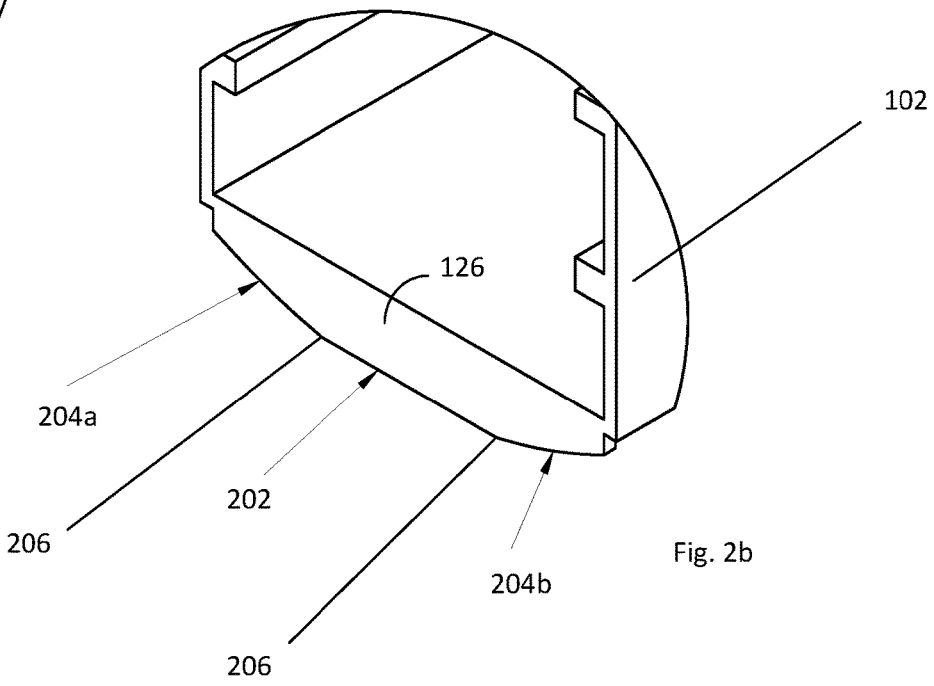

FIGS. 2*a* and 2*b* depict an alternate embodiment of a modular building block sorter. In the embodiment depicted in FIGS. 2*a* and 2*b*, the base 126 has the shape of a truncated arc comprised of a substantially flat surface 202 and two arced surfaces 204*a* 204*b*. In use, the housing 102 is stable when vertical and resting on the substantially flat surface 202 and when agitated or rocked over the discontinuity 206 the housing 102, trays 104 106 108 110 112, various perforated surfaces 116 118 120 122 and substantially solid surface 114 are subject to vertical acceleration due to the transition over the discontinuity 206. Thus, when modular building blocks are introduced into the top tray 112 and the housing 102 agitated/rocked across the discontinuity 206 the modular building blocks translate in the horizontal plane and vertically due to the vertical component of acceleration.

Figure 3A:
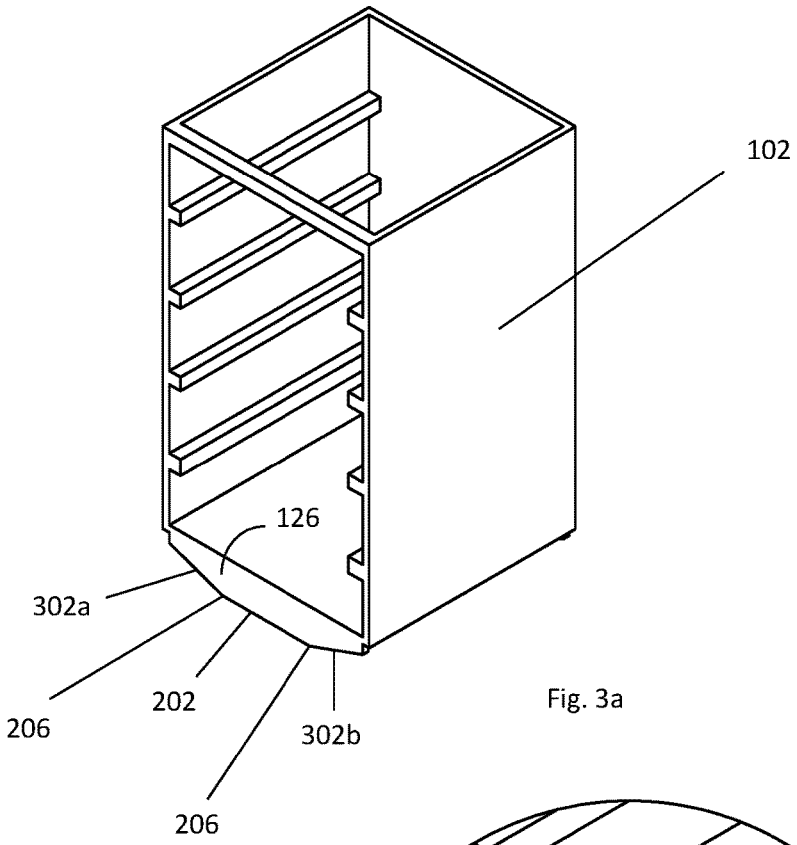
FIGS. 3*a* and 3*b* depict an alternate embodiment of a modular building block sorter
Figure 3B:
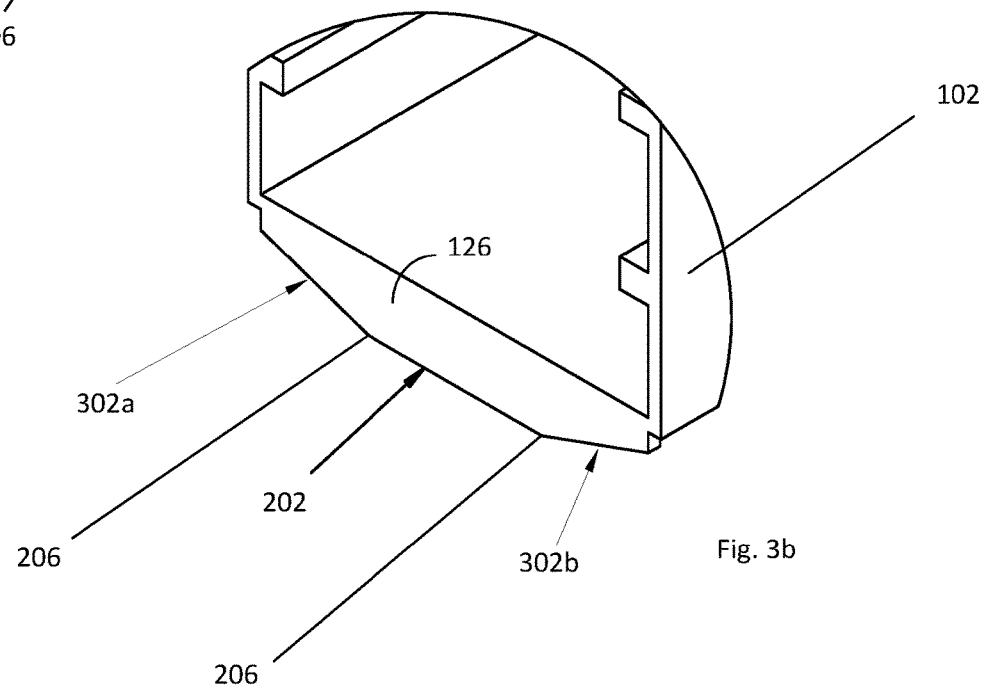

FIGS. 3*a* and 3*b* depict an alternate embodiment of a modular building block sorter. In the embodiment depicted in FIGS. 3*a* and 3*b*, the base 126 has the cross-sectional shape of a truncated triangle comprised of a substantially flat surface 202 and two angled substantially planar surfaces 302*a* 302*b*. In use, the housing 102 is stable when vertical and resting on the substantially flat surface 202 and when agitated or rocked over the discontinuity 206 the housing 102, trays 104 106 108 110 112, various perforated surfaces 116 118 120 122 and substantially solid surface 114 are subject to vertical acceleration due to the transition over the discontinuity 206. Thus, when modular building blocks are introduced into the top tray 112 and the housing 102 agitated/rocked across the discontinuity 206 the modular building blocks translate in the horizontal plane and vertically due to the vertical component of acceleration.

Figure 4A:
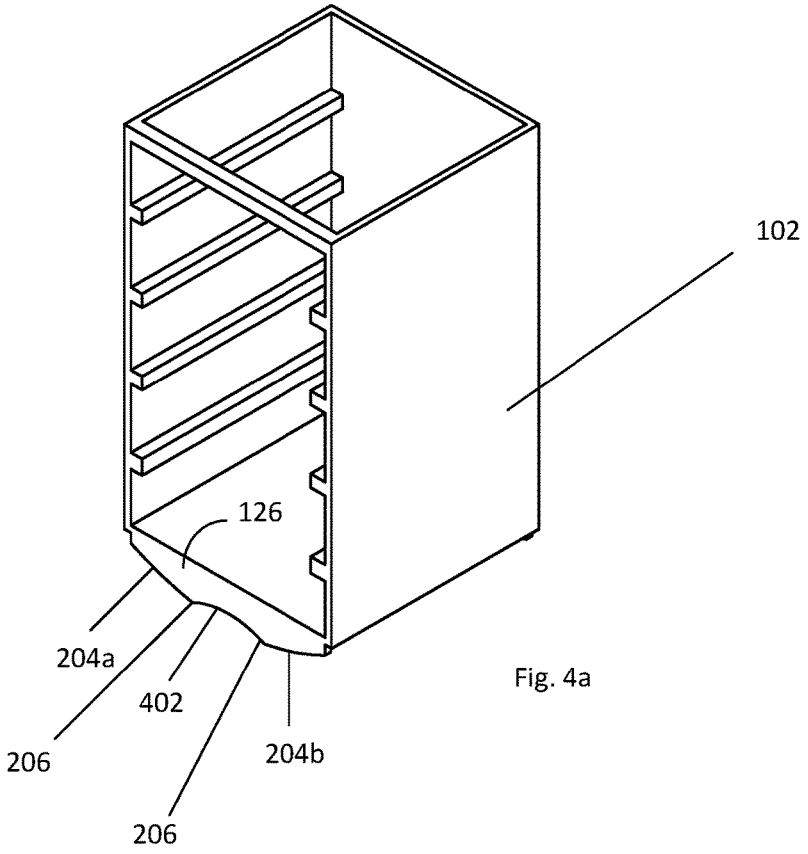
FIGS. 4*a* and 4*b* depict an alternate embodiment of a modular building block sorter
Figure 4B:
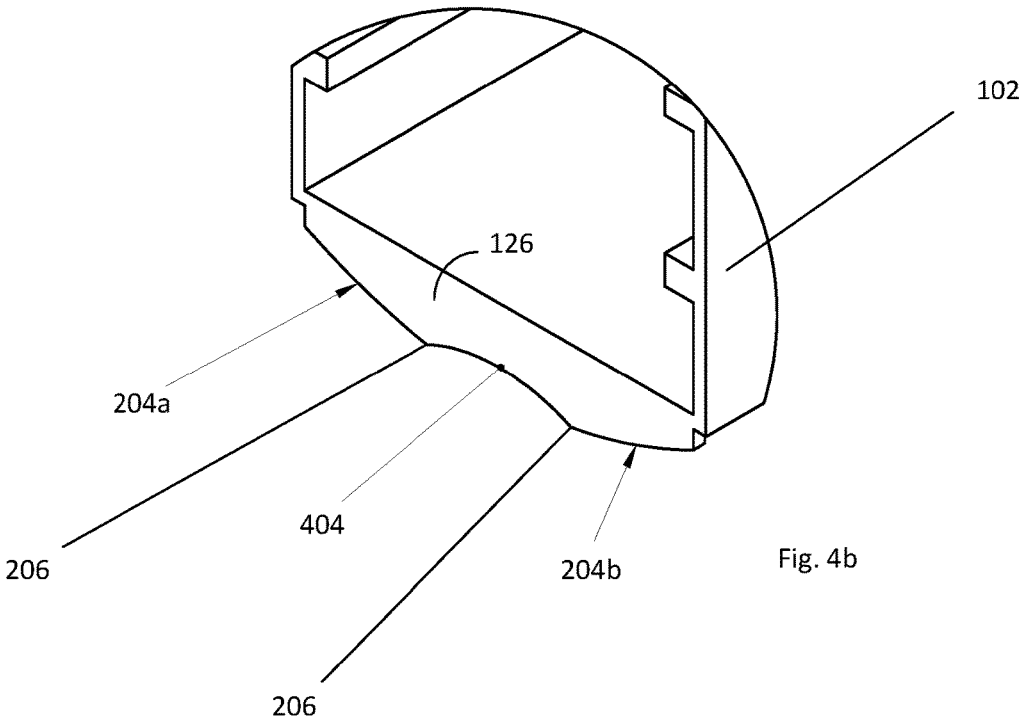

FIGS. 4*a* and 4*b* depict an alternate embodiment of a modular building block sorter. In the embodiment depicted in FIGS. 4*a* and 4*b*, the base 126 has the cross-sectional shape of two arc regions 204*a* 204*b* with a central inverted arc cutout 402. In use, the housing 102 is stable when vertical and resting on the discontinuities 206 between the arc regions 204*a* 204*b* and the central inverted arc cutout 402 and when agitated or rocked over the discontinuities 206 the housing 102, trays 104 106 108 110 112, various perforated surfaces 116 118 120 122 and substantially solid surface 114 are subject to vertical acceleration due to the transition over the discontinuity 206. Thus, when modular building blocks are introduced into the top tray 112 and the housing 102 agitated/rocked across the discontinuities 206 the modular building blocks translate in the horizontal plane and vertically due to the vertical component of acceleration.

Figure 5A:
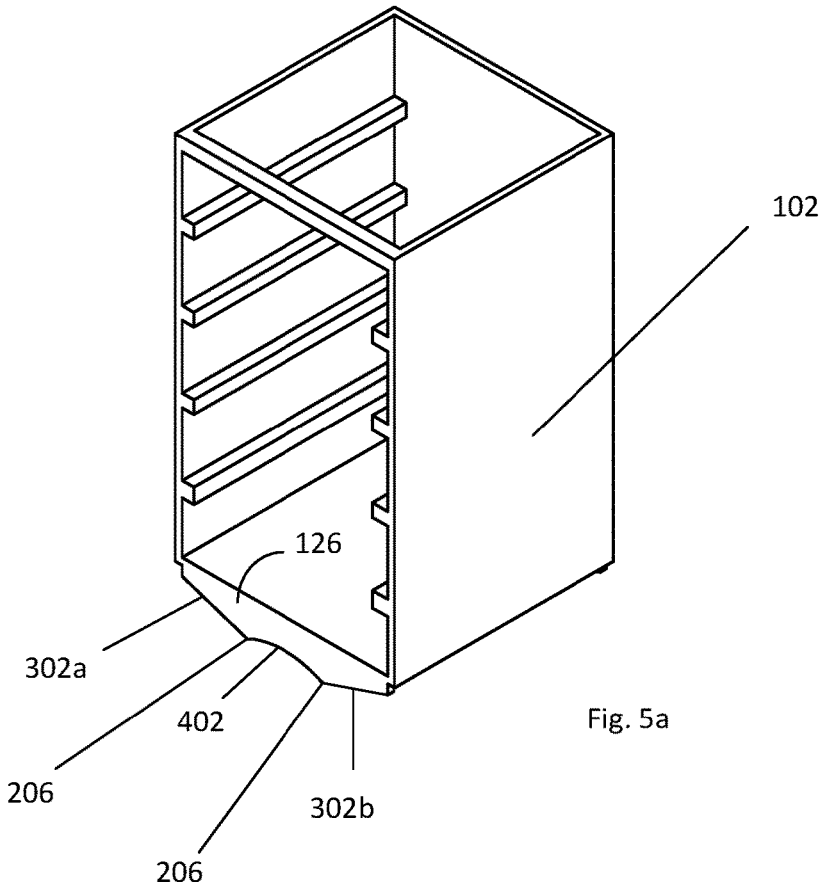
FIGS. 5*a* and 5*b* depict an alternate embodiment of a modular building block sorter
Figure 5B:
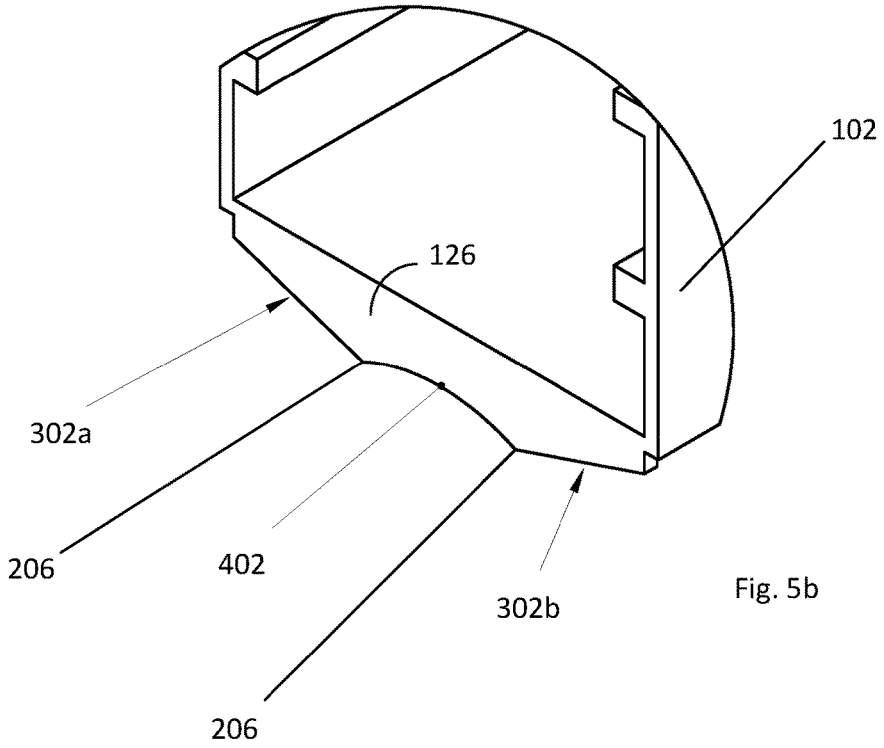

FIGS. 5*a* and 5*b* depict an alternate embodiment of a modular building block sorter. In the embodiment depicted in FIGS. 5*a* and 5*b*, the base 126 has the cross-sectional shape of two substantially planar regions 302*a* 302*b* with a central inverted arc cutout 402. In use, the housing 102 is stable when vertical and resting on the discontinuities 206 between the substantially planar regions 302*a* 302*b* and the central inverted arc cutout 402 and when agitated or rocked over the discontinuities 206 the housing 102, trays 104 106 108 110 112, various perforated surfaces 116 118 120 122 and substantially solid surface 114 are subject to vertical acceleration due to the transition over the discontinuity 206. Thus, when modular building blocks are introduced into the top tray 112 and the housing 102 agitated/rocked across the discontinuities 206 the modular building blocks translate in the horizontal plane and vertically due to the vertical component of acceleration.

Figure 6A:
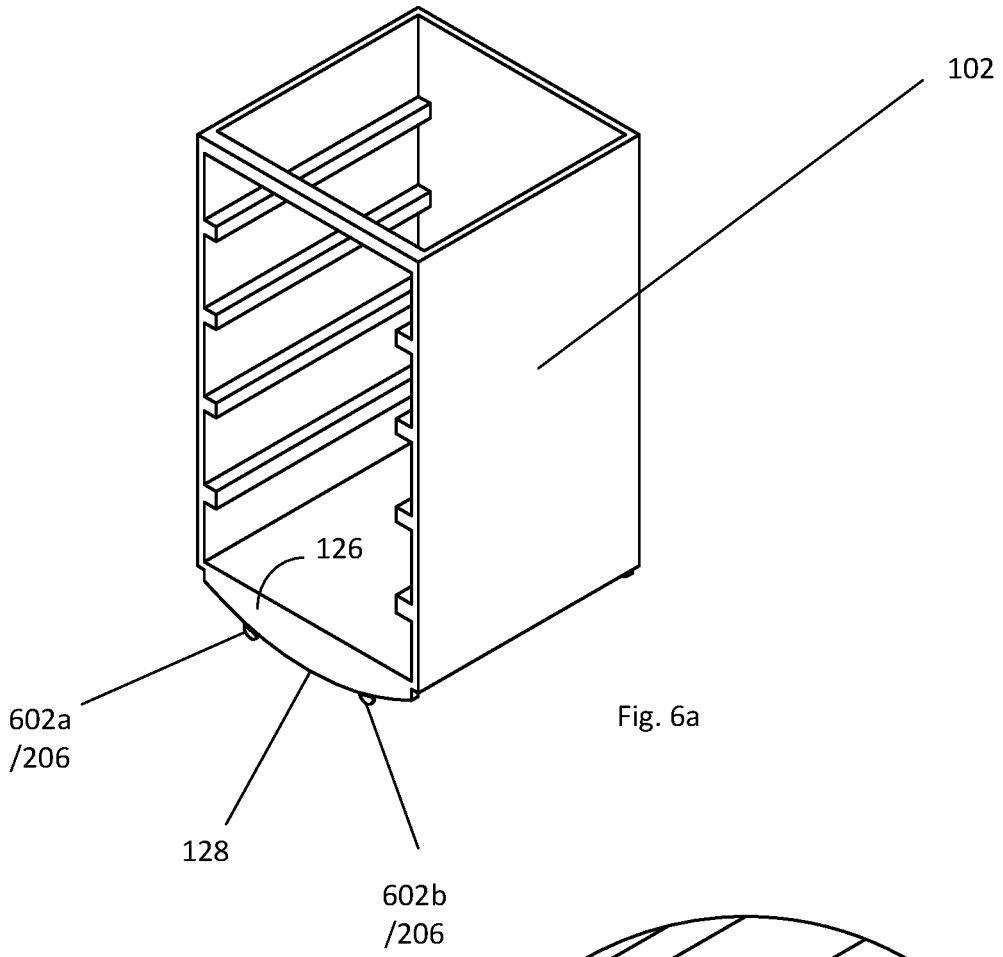
FIGS. 6*a* and 6*b* depict an alternate embodiment of a modular building block sorter
Figure 6B:
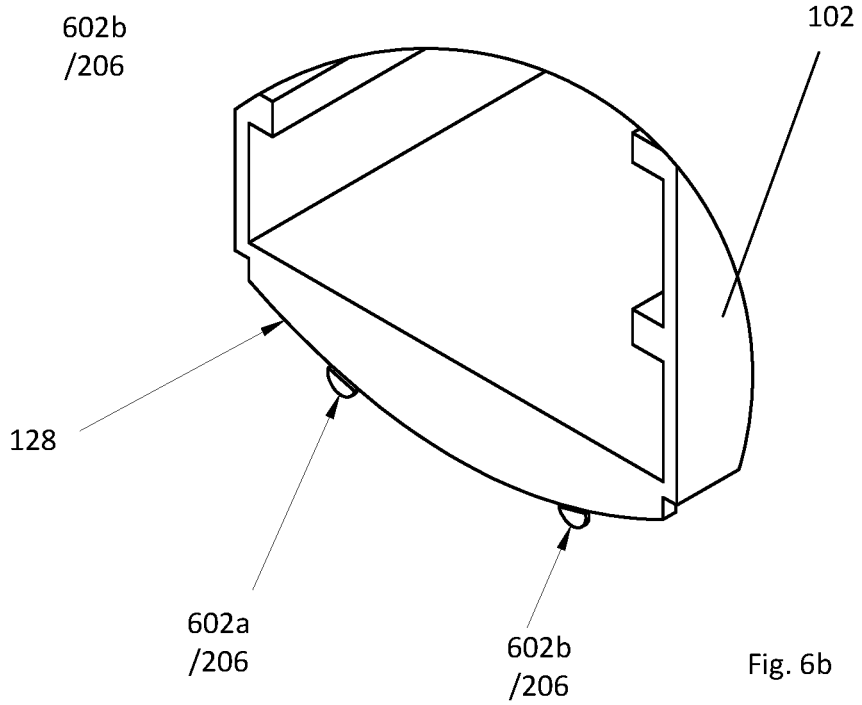

FIGS. 6*a* and 6*b* depict an alternate embodiment of a modular building block sorter. In the embodiment depicted in FIGS. 6*a* and 6*b*, the base 126 has 2*a* and overall arced cross-sectional shape 128 with two protrusions 602*a* 602*b* along the length of the arc 128. In some embodiments, the protrusions 602*a* 602*b* can be positioned at the exterior boundary(ies) of the base 126 of the housing 102. However, in alternate embodiments, the protrusions 602*a* 602*b* can be positioned in any known, convenient and/or desired position (s) on the base 126 of the housing 102 and can run any known, convenient and/or desired length of the housing 102. In use, the housing 102 is stable when vertical and resting on a portion of the arc 128 and at least one of the protrusions 602*a* 602*b* and when agitated or rocked over one or more of the protrusions 602*a* 602*b* the housing 102, trays 104 106 108 110 112, various perforated surfaces 116 118 120 122 and substantially solid surface 114 are subject to vertical acceleration due to the transition over the protrusions 602*a* 602*b* which create surface discontinuities in the base 126 and arc 128. Thus, when modular building blocks are introduced into the top tray 112 and the housing 102 agitated/rocked over the protrusions 602*a* 602*b*/across the discontinuities the modular building blocks translate in the horizontal plane and vertically due to the vertical component of acceleration.

FIGS. 7*a*-9*b* depict bottom views of alternate embodiments of base 126 configurations of the modular building block sorter 100.

Figure 7A:
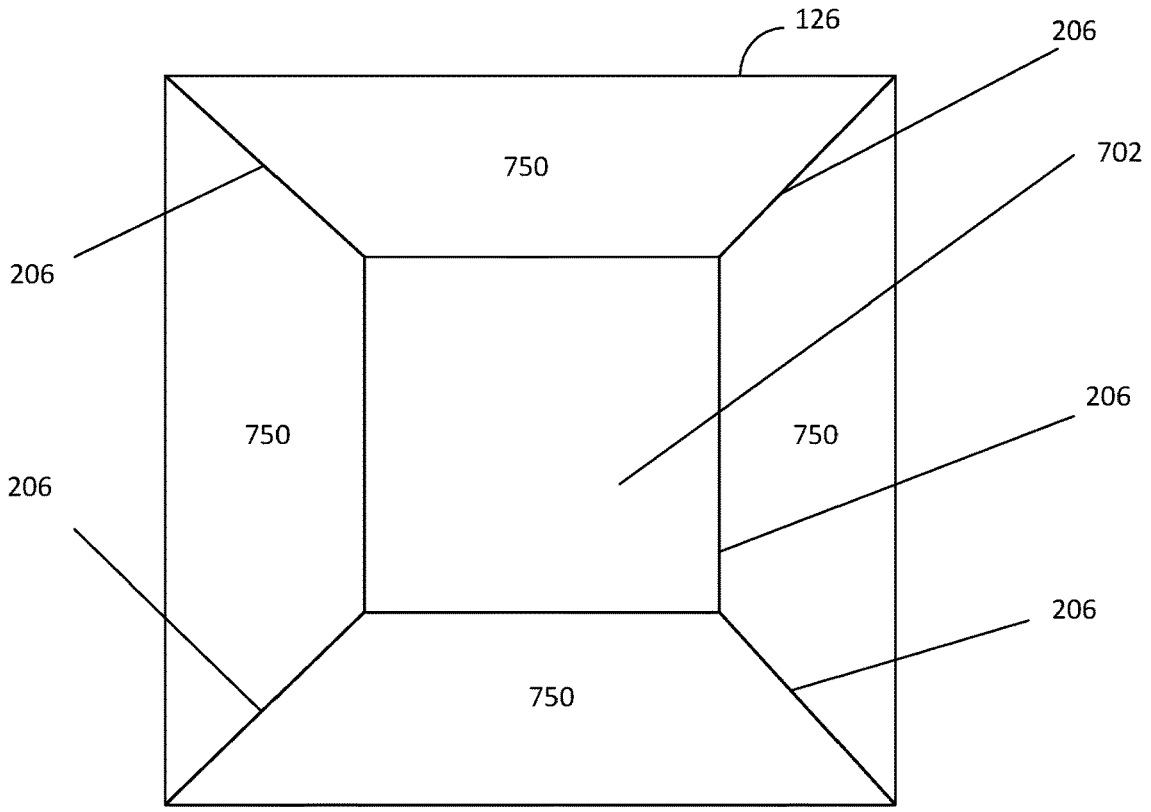
FIGS. 7*a*-9*b* depict alternate embodiments of base configurations of modular building block sorters.
Figure 7B:
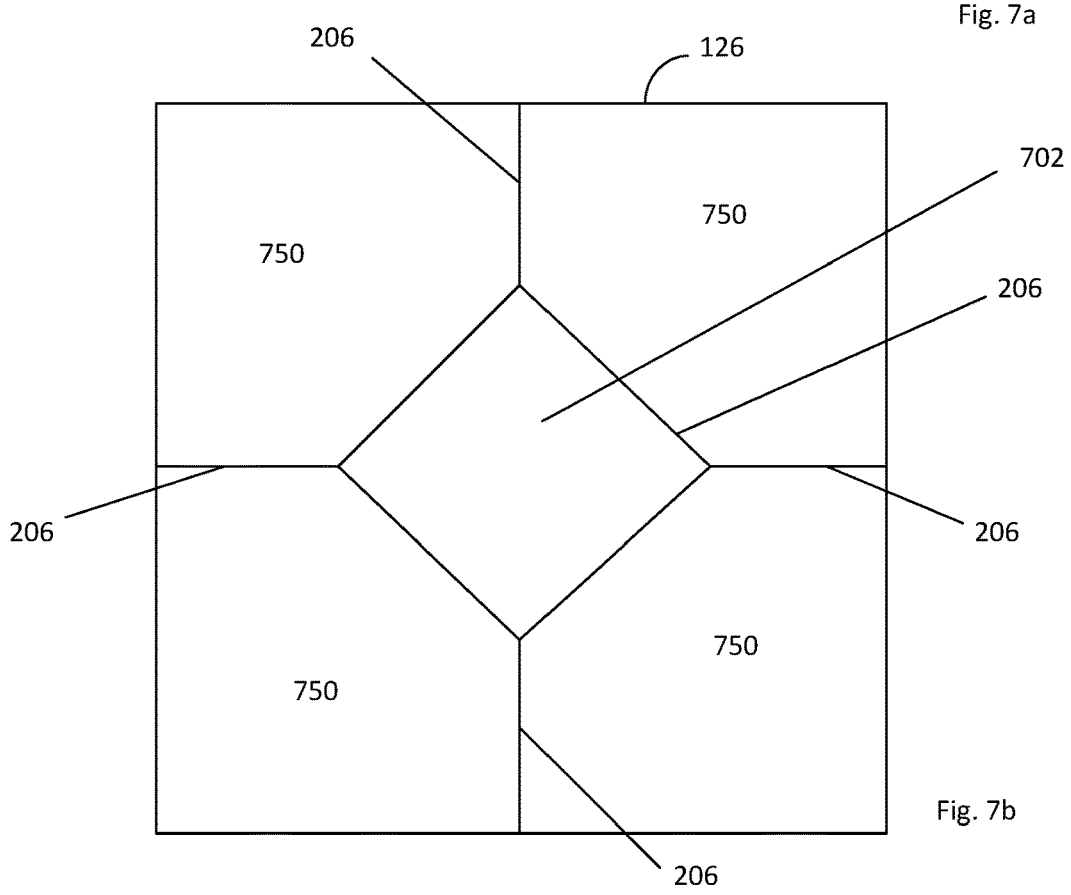

In the embodiment depicted in FIGS. 7*a* and 7*b* there are depicted a substantially planar surface 702 and four planar surfaces 750 such that the base 126 has the shape of a truncated 4-sided pyramid, thus creating 8 discontinuities 206. When agitated or rocked over the discontinuities 206 the housing 102, trays 104 106 108 110 112, various perforated surfaces 116 118 120 122 and substantially solid surface 114 are subject to vertical acceleration due to the transition over the discontinuity 206. Thus, when modular building blocks are introduced into the top tray 112 and the housing 102 agitated/rocked across the discontinuities 206 the modular building blocks translate in the horizontal plane and vertically due to the vertical component of acceleration.

Figure 8A:
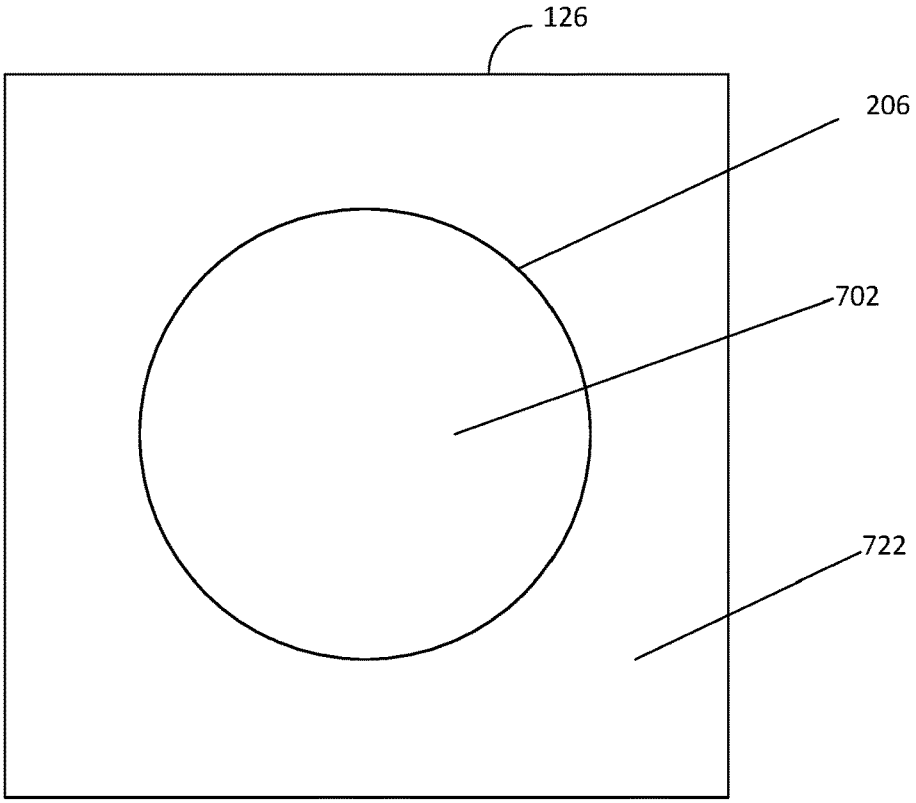
Figure 8B:
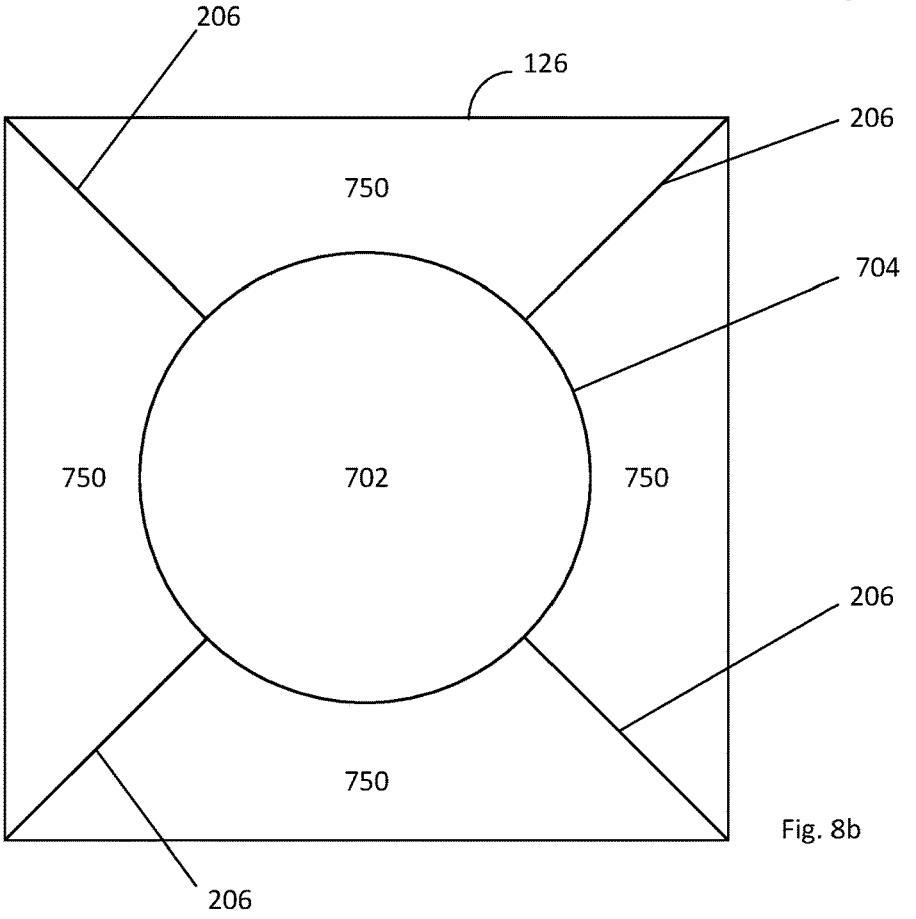

In the embodiment depicted in FIG. 8*a* there are depicted a substantially planar surface 702 and a single curved surface 722 such that the base 126 has the shape of a truncated dome having a circular discontinuity 206. When agitated or rocked over the discontinuity 206 the housing 102, trays 104 106 108 110 112, various perforated surfaces 116 118 120 122 and substantially solid surface 114 are subject to vertical acceleration due to the transition over the discontinuity 206. Thus, when modular building blocks are introduced into the top tray 112 and the housing 102 agitated/rocked across the discontinuity 206 the modular building blocks translate in the horizontal plane and vertically due to the vertical component of acceleration In the embodiment depicted in FIG. 8*b* there are depicted a substantially planar surface 702 and four planar surfaces 750 such that the base 126 has the shape of a truncated 4-sided pyramid, thus creating 8 discontinuities 206. When agitated or rocked over the discontinuities 206 the housing 102, trays 104 106 108 110 112, various perforated surfaces 116 118 120 122 and substantially solid surface 114 are subject to vertical acceleration due to the transition over the discontinuity 206. Thus, when modular building blocks are introduced into the top tray 112 and the housing 102 agitated/rocked across the discontinuities 206 the modular building blocks translate in the horizontal plane and vertically due to the vertical component of acceleration.

Figure 9A:
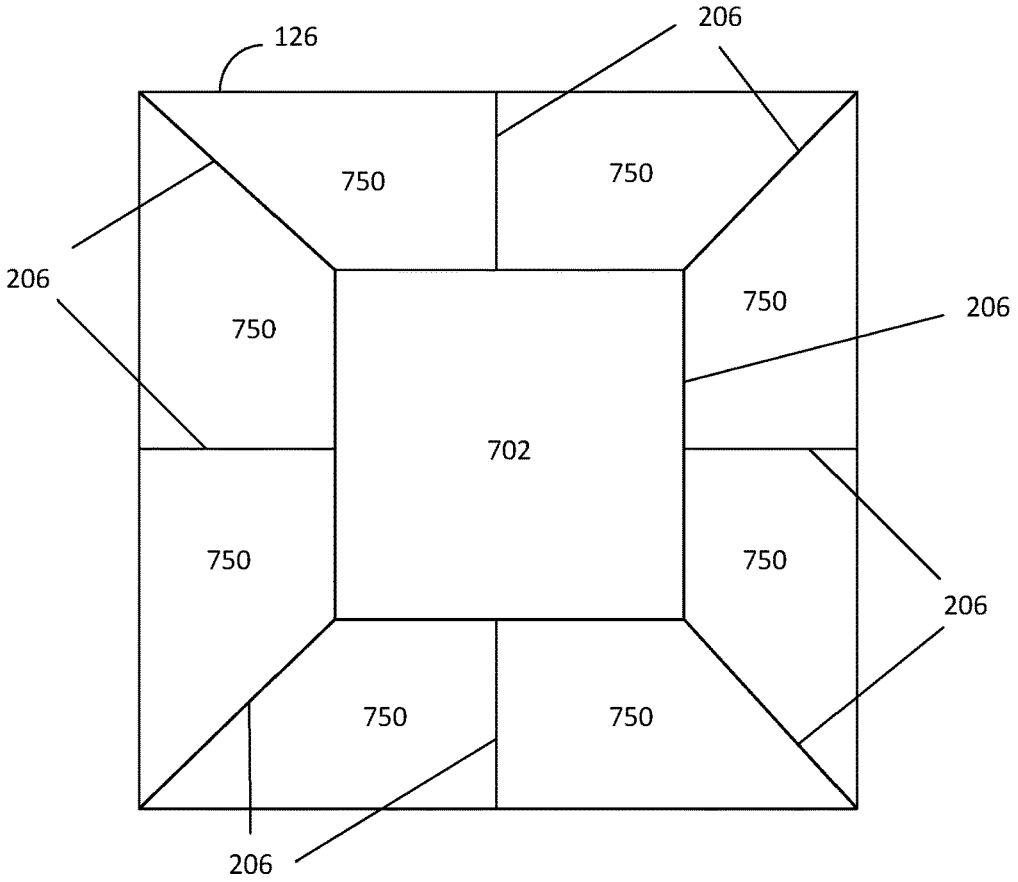
Figure 9B:
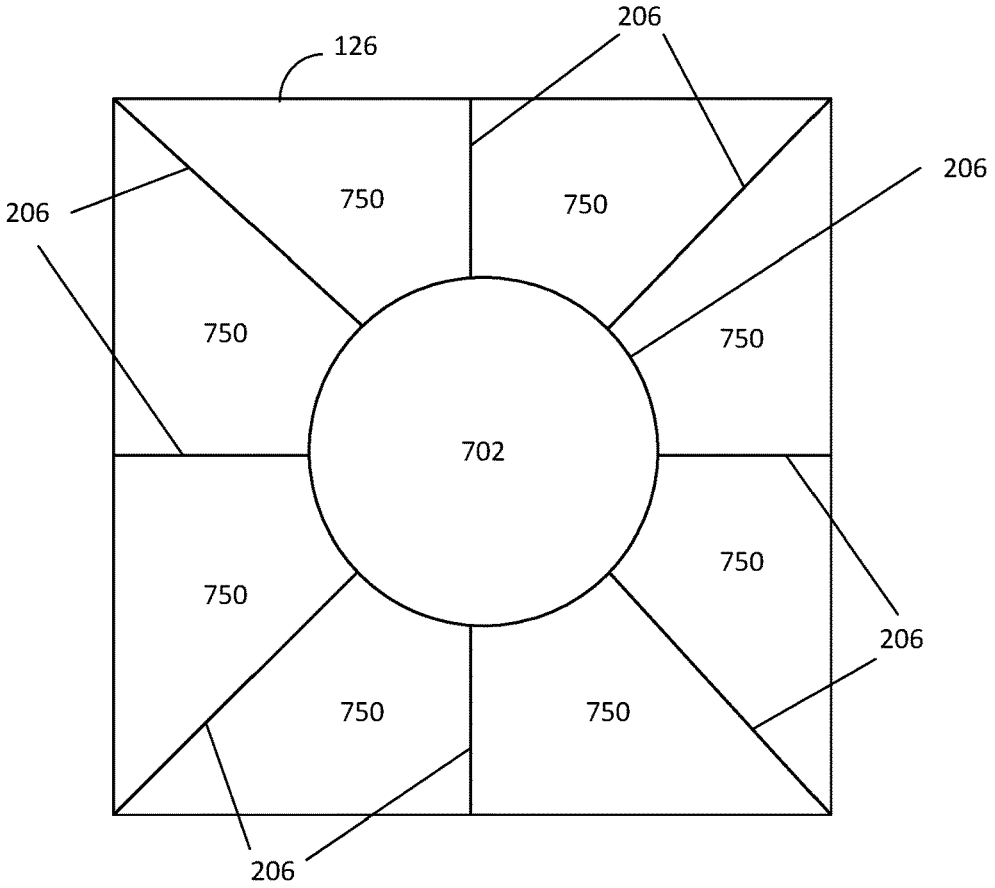
Figure 10A:
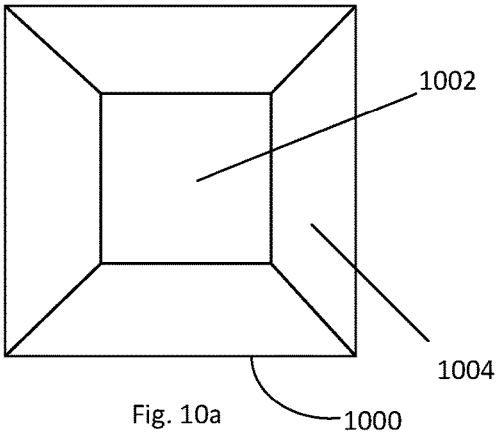
FIGS. 10*a*-10*i* depict embodiments of apertures in the perforated surfaces.
Figure 10B:
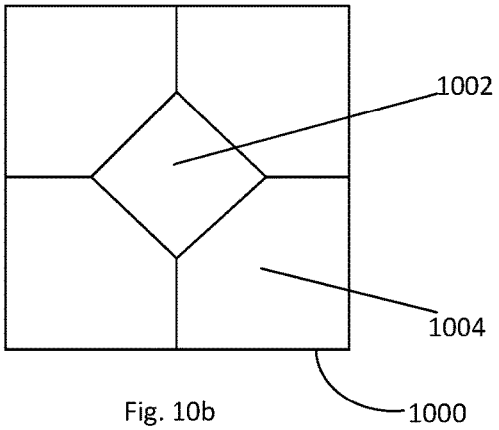
Figure 10C:
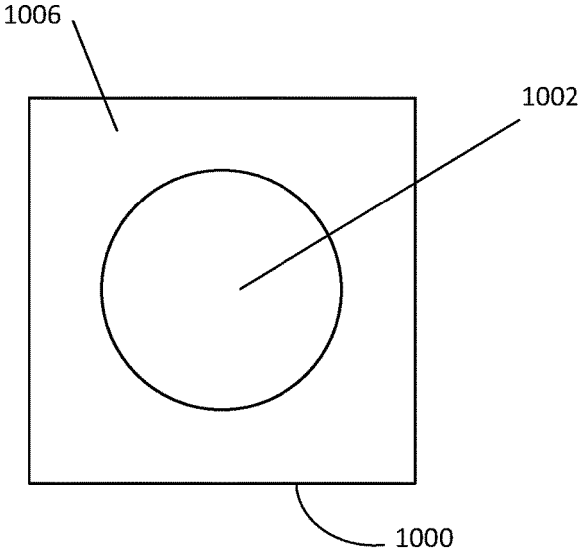
Figure 10D:
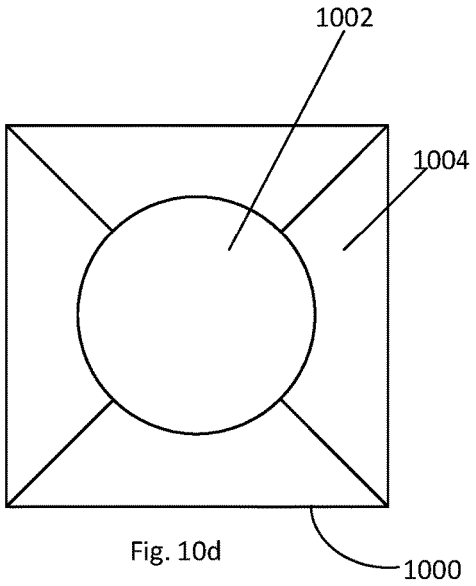
Figure 10E:
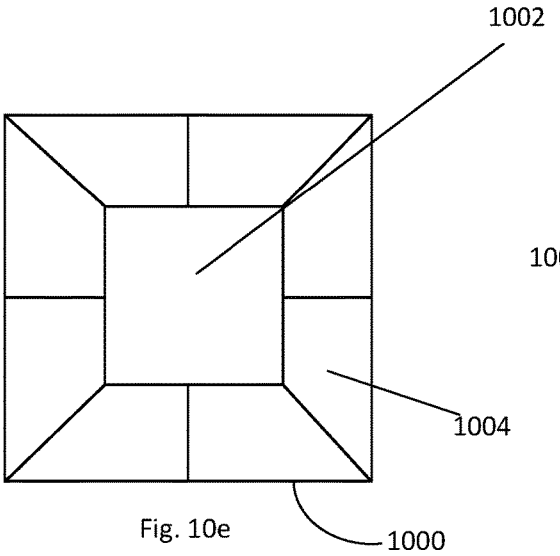
Figure 10F:
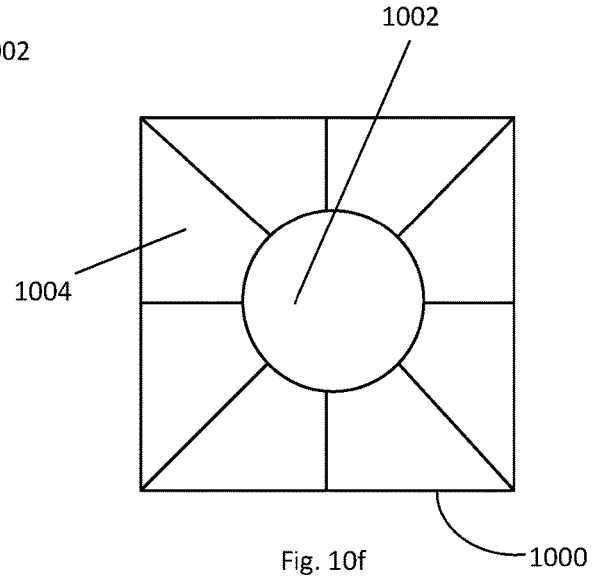
Figure 10G:
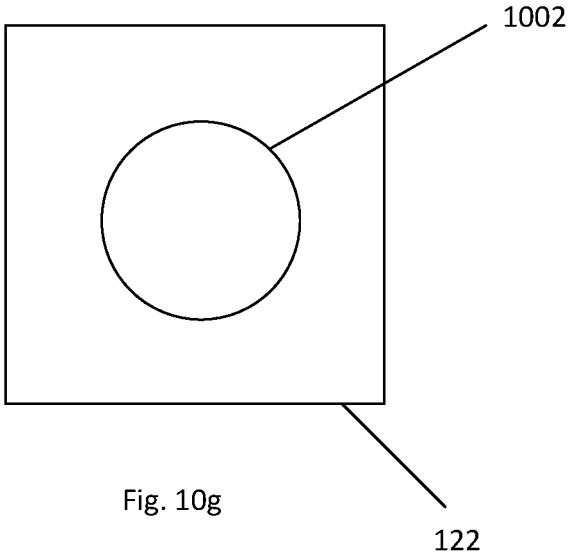
Figure 10H:
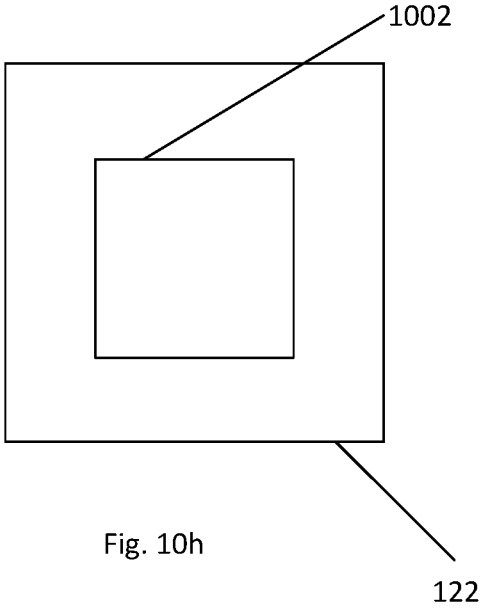
Figure 10I:
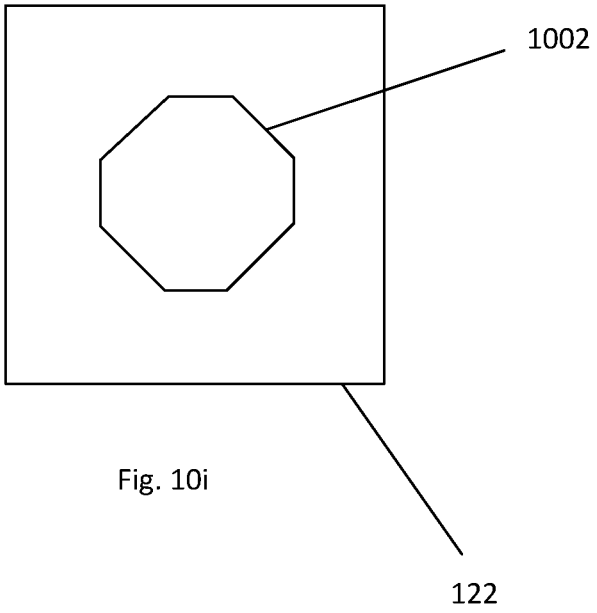

In the embodiment depicted in FIGS. 9*a* and 9*b* there are depicted a substantially planar surface 702 and a plurality of planar surfaces 750 such that the base 126 has the shape of a truncated polyhedral, thus creating any known, convenient and/or desired number of discontinuities 206. When agitated or rocked over the discontinuities 206 the housing 102, trays 104 106 108 110 112, various perforated surfaces 116 118 120 122 and substantially solid surface 114 are subject to vertical acceleration due to the transition over the discontinuity 206. Thus, when modular building blocks are introduced into the top tray 112 and the housing 102 agitated/rocked across the discontinuities 206 the modular building blocks translate in the horizontal plane and vertically due to the vertical component of acceleration.

FIGS. 10*a*-10*i* depict top view embodiments of apertures 1000 in the perforated surfaces 116 118 120 122. In the embodiments depicted in FIGS. 10*a* and 10*f*, the aperture 1000 can comprise of a hole in the lower face of the perforated surfaces 116 118 120 122 and a plurality of sloped surfaces 1004 that are declined from a top face of the perforated surface toward the hole 1002 located at the bottom face of the perforated surfaces 116 118 120 122. In some embodiments such as FIGS. 10*a*, 10*b* and 10*c*-10*f*, the surfaces 1004 can be planar. However, in alternate embodiments such as FIG. 10*c*, the surface can be curved 1006. Moreover, in some embodiments, such as those depicted in FIGS. 10*g*-10*i*, the hole 1002 can be substantially orthogonal to the plane of the perforated surfaces 116 118 120 122. Additionally, it should be well understood by those of ordinary skill in the art that the presented apertures 1000, holes 1002, surfaces 1004, curves, 1006 are illustrative only any can have any known, convenient and/or desired geometric configurations. Moreover, it should be well understood by those of ordinary skill in the art that while a single perforated surface 116 118 120 122 can be designed to allow passage of modular building blocks less than a specified dimension to pass through it, the apertures 1000 in either each of or within the individual perforated surfaces need not be the same or identical. Thus, a single perforates surface, for example 122 can comprise multiple different apertures 1000 and/or in some embodiments can comprise apertures 1000 of a single type/style.

Figure 11:
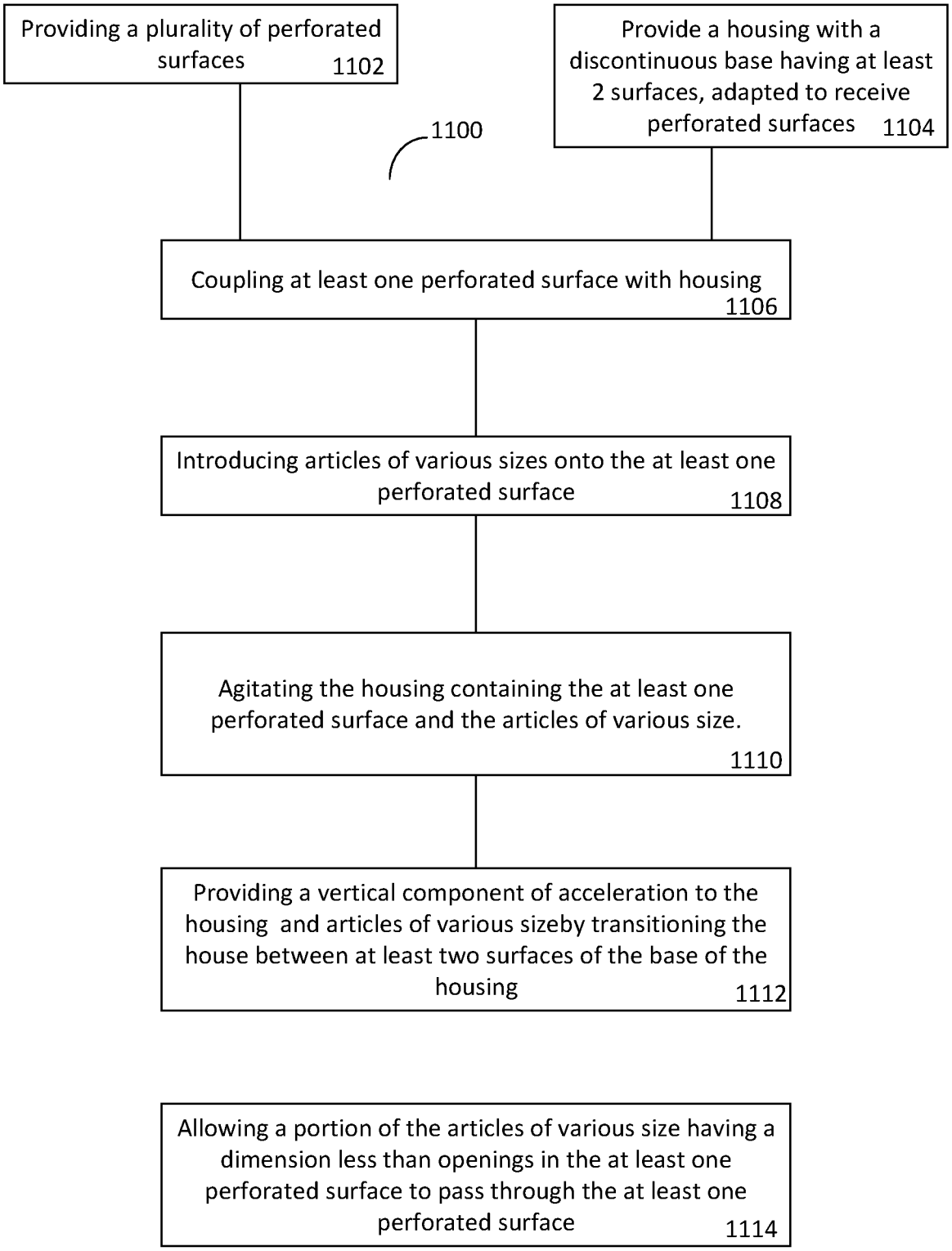
FIG. 11 depicts a method of sorting modular building blocks.

FIG. 11 depicts a method 1100 of sorting modular building blocks. In step 1102 a plurality of perforated surfaces 116 118 120 122 are provided or obtained, each of the perforated surfaces 116 118 120 122 being adapted and configured to allow block having less than a specified dimension to pass through the apertures 1000 in the perforated surfaces 116 118 120 122.

In step 1104 a housing 102 adapted and configured to support the plurality of perforated surfaces 116 118 120 122 is provided or obtained. Then in step 1006, at least one of the perforated surfaces 116 118 120 122 is coupled with the housing 102. In some embodiments in which a plurality of perforated surfaces 116 118 120 122 are coupled with the housing 102, the perforated surfaces 116 118 120 122 can be coupled with the housing 102 such that the size of the apertures 1000 increase with the distance from the base 126 of the housing 102.

In step 1008 the modular building blocks are introduced onto the at least one perforated surface coupled with the housing 102 and then in step 1110, the housing. The base 126 of the housing 102 comprises one or more discontinuities 206 such that as the base is agitated in step 1110, a vertical component of acceleration is introduced into the system in step 1112 as the base 126 transitions across the discontinuities 206 with the base 126 is in contact with a surface upon which it is resting. Then in step 1114 modular building blocks can pass through the at least one perforated surface toward the base 126 based at least in part on the vertical component of acceleration from step 1112.

Although exemplary embodiments of the invention have been described in detail and in language specific to structural features and/or methodological acts above, it is to be understood that those skilled in the art will readily appreciate that many additional modifications are possible in the exemplary embodiments without materially departing from the novel teachings and advantages of the invention. Moreover, it is to be understood that the subject matter defined in the appended claims is not necessarily limited to the specific features or acts described above. Accordingly, these and all such modifications are intended to be included within the scope of this invention construed in breadth and scope in accordance with the appended claims.

What is claimed is:

1. A modular building block sorter comprising:

a housing having at least two sides and a base; and at least one tray comprising a perforated surface, said at least one tray adapted to be selectively supported by complimentary geometry of said at least two sides of said housing;

wherein said base has a non-arcuate bottom profile comprising at least one discontinuity defining a first portion and a second portion; and wherein said first portion of said base is substantially orthogonal to at least one of said at least two sides of said base.

2. The modular building block sorter of claim 1 wherein said base comprises an arc.

3. The modular building block sorter of claim 1 wherein said discontinuity is at a common edge of said first portion and said second portion.

4. The modular building block sorter of claim 3 wherein said second portion of said base is other than substantially orthogonal to said at least one of said at least two sides of said base.

5. The modular building block sorter of claim 3 wherein said first portion of said base is arced.

6. The modular building block sorter of claim 1 wherein said second portion of said base is arced.

7. The modular building block sorter of claim 1 wherein said second portion is substantially planar.

8. The modular building block sorter of claim 3 wherein transitioning of contact of the base with a surface from a first portion of the base to a second portion of the base results in an acceleration on said housing substantially parallel to at least one of said at least two sides of said housing.

9. A modular building block sorter comprising:

a housing having at least two sides and a base; and at least one tray comprising a perforated surface, said at least one tray adapted to be selectively supported by complimentary geometry of said at least two sides of said housing;

wherein said base has a non-arcuate bottom profile comprising at least one discontinuity defining a first portion and a second portion; and wherein said second portion of said base is other than substantially orthogonal to said at least one of said at least two sides of said base.

10. The modular building block sorter of claim 9 wherein said base comprises an arc.

11. The modular building block sorter of claim 9 wherein said discontinuity is at a common edge of said first portion and said second portion.

12. The modular building block sorter of claim 9 wherein said first portion of said base is substantially orthogonal to at least one of said at least two sides of said base.

13. The modular building block sorter of claim 11 wherein said first portion of said base is arced.

14. The modular building block sorter of claim 9 wherein said second portion of said base is arced.

15. The modular building block sorter of claim 9 wherein said second portion is substantially planar.

16. The modular building block sorter of claim 11 wherein transitioning of contact of the base with a surface from a first portion of the base to a second portion of the base results in an acceleration on said housing substantially parallel to at least one of said at least two sides of said housing.

* * * * *